US010118796B2

(12) United States Patent
Nikovski et al.

(10) Patent No.: US 10,118,796 B2
(45) Date of Patent: Nov. 6, 2018

(54) SYSTEM AND METHOD FOR GROUP ELEVATOR SCHEDULING BASED ON SUBMODULAR OPTIMIZATION

(71) Applicant: Mitsubishi Electric Research Laboratories, Inc., Cambridge, MA (US)

(72) Inventors: Daniel Nikolaev Nikovski, Brookline, MA (US); Arvind U Raghunathan, Brookline, MA (US); Srikumar Ramalingam, Salt Lake City, UT (US)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 71 days.

(21) Appl. No.: 15/448,644

(22) Filed: Mar. 3, 2017

(65) Prior Publication Data

US 2018/0251335 A1 Sep. 6, 2018

(51) Int. Cl.
*B66B 1/24* (2006.01)

(52) U.S. Cl.
CPC ..... *B66B 1/2458* (2013.01); *B66B 2201/20* (2013.01); *B66B 2201/34* (2013.01)

(58) Field of Classification Search
CPC ..... B66B 1/2458; B66B 2201/20; B66B 2201/34
USPC ..... 187/247
See application file for complete search history.

(56) References Cited

U.S. PATENT DOCUMENTS

| | | | | |
|---|---|---|---|---|
| 7,484,597 | B2 | 2/2009 | Nikovski et al. | |
| 7,546,905 | B2 | 6/2009 | Nikovski et al. | |
| 9,834,405 | B2 * | 12/2017 | Nikovski | B66B 1/2458 |
| 2003/0221915 | A1 * | 12/2003 | Brand | B66B 1/2458 187/382 |
| 2007/0221454 | A1 * | 9/2007 | Nikovski | B66B 1/18 187/382 |
| 2007/0221455 | A1 * | 9/2007 | Nikovski | B66B 1/18 187/384 |
| 2012/0197868 | A1 * | 8/2012 | Fauser | G06F 17/30286 707/714 |
| 2012/0267201 | A1 * | 10/2012 | Brand | B66B 1/2458 187/382 |

(Continued)

FOREIGN PATENT DOCUMENTS

WO WO 2014198302 A1 * 12/2014 ..... B66B 1/2466

*Primary Examiner* — David Warren
(74) *Attorney, Agent, or Firm* — Gennadiy Vinokur; James McAleenan; Hironori Tsukamoto

(57) ABSTRACT

Systems and Methods for controlling a movement of cars of an elevator system. A processor determines for each car an individual waiting time of each hall call. Determines for each pair of hall calls assigned for each car, a pairwise delay over the individual waiting time of each hall call in the pair caused by a joint assignment of the car to the pair of the hall calls. Approximate a cumulative waiting time of an assignment of the cars to the hall calls as a sum of individual waiting times for each hall call with the assigned car and a sum of all pairwise delays determined between all pairs of hall calls assigned to the same car. Determine the assignment of the cars using a greedy optimization algorithm that greedily assigns hall calls to the cars to minimize the approximated cumulative waiting time, and control the movement of the cars.

20 Claims, 6 Drawing Sheets

(56) References Cited

U.S. PATENT DOCUMENTS

| | | | | |
|---|---|---|---|---|
| 2016/0130112 | A1* | 5/2016 | Nikovski | B66B 1/2458<br>187/247 |
| 2016/0289042 | A1* | 10/2016 | Fang | G06T 7/10 |
| 2016/0289043 | A1* | 10/2016 | Fang | B66B 13/146 |
| 2017/0369275 | A1* | 12/2017 | Saraswat | B66B 1/28 |

* cited by examiner

SYSTEM AND METHOD FOR GROUP ELEVATOR SCHEDULING BASED ON SUBMODULAR OPTIMIZATION

RELATED APPLICATION

This application is related to U.S. Pat. No. 7,484,597 entitled "System and Method for Scheduling Elevator Cars Using Branch-and-Bound," dated Feb. 3, 2009 by Nikovski et al., and U.S. Pat. No. 7,546,905 entitled "System and method for scheduling elevator cars using pairwise delay minimization," dated Jun. 16, 2009 by Nikovski et al.

FIELD

The present disclosure relates generally to scheduling elevator cars, and more particularly to scheduling methods and systems that operate according to a continuous reassignment policy until an actual time of pick up.

BACKGROUND

Scheduling elevator cars is a practical optimization problem for banks of elevators in buildings. The most common instance of this problem deals with assigning elevator cars to passengers as they arrive at the bank of elevators, and request service by means of one of two buttons (up or down). The object is to assign arriving passengers to cars so as to optimize one or more performance criteria such as waiting time, total transfer time, percentage of people waiting longer than a specific threshold, or fairness of service.

An important consideration is the assignment policy used by the scheduler. One possible assignment policy is when each assignment is made at the time of the hall call of the arriving passenger, and the assignment is not changed until the passenger is served. This is called an immediate policy. On the other hand, the system can continuously reassign hall calls to different cars if this improves the schedule. This is called a reassignment policy. While the reassignment policy increases the computational complexity of scheduling, the additional degrees of freedom can be exploited to achieve major improvements of the average weight time (AWT).

In practice, it is assumed that passenger dissatisfaction grows supra-linearly as a function of the average weight time (AWT). When minimizing objective functions, one penalizes long waits much stronger than short waits, which helps to reduce extensive long waits. However, due to the high economic and social impact of transportation efficiency in buildings, many scheduling algorithms have been proposed to reduce the AWT of elevator passengers. Yet, there are several significant obstacles to achieving the shortest possible AWT in a given building. The main obstacle is the high combinatorial complexity of the scheduling problem. In a building that has an elevator bank with C cars, if N passengers must be assigned to these cars, there are $C^N$ possible assignments, each of which resulting in a different AWT value for passengers. Even for moderate passenger and car numbers, finding the optimal assignment by means of exhaustive enumeration of all assignments is computationally very difficult, with exponential complexity $O(C^N)$. Such a solution is not feasible, given the fast reaction times required by the elevator control system. Multiple heuristic and approximate algorithms have been proposed to deal with this huge combinatorial complexity, but most of them have major shortcomings that result in substatial suboptimality, as described below.

One of the earliest scheduling algorithms that is still used in a large number of deployed elevator installations is the nearest car algorithm, where each passenger is assigned to the nearest car that is approaching that passenger. This method is computationally very easy, and has computational complexity of only O(CN). However, bacause every passenger is assigned to a car without any consideration for the other passengers assigned to the same car, it completely ignores the delays that picking some passengers would cause to the pick up time and wait of other passengers. As a result, its AWT is very far from optimal. Moreover, it often results in bunching, where the elevator cars are distributed very unevenly around the building, and are poorly positioned to respond to new calls.

Another class of scheduling methods operate in the so-called immediate assignment mode, where a new passenger is assigned to a car immediately after service is requsted by the passenger, and this assignment is never reconsidered. However, the need to commit as early as possible to a particular assignment of passengers to cars (at the time of the initial call for service) deprives the scheduler from the possibility of revising the assignments if the situation changes before the assigned car reaches the passenger. That the situation will change is almost certain, and there are multiple reasons for that. The main reason is the arrival of future new passengers, whose arrival was not known at the time when the original assignment was made. When such new arrivals occur, it is often advantageous to reconsider the initial assignments, and sometimes change the entire schedule of the elevator bank. Another reason why the situation might change is that the execution of the current schedule often does not proceed as planned, for example when passengers hold the doors open longer than usual, or an entire group of passengers has initiated the service call and needs a lot more time of enter or exit the car. Constantly reconsidering all the assignments of all outstanding service calls to the available cars, called reassignment mode, usually results in much shorter AWT than when immediate assignment is used.

As noted, optimally solving the scheduling problem in reassignment mode has exponential complexity, and exhaustive enumeration of all possible solutions is not feasible. A general-purpose method for eliminating many of the possible solutions in combinatorial optimization problems is the branch-and-bound method. Nikovski et al., U.S. Pat. No. 7,484,597, System and Method for Scheduling Elevator Cars Using Branch-and-Bound, describe how this method can be applied to the group elevator scheduling problem in re-assignment mode. Although this method can be much faster than full exhaustive enumeration, its worst-case complexity is still exponential in the number of cars and calls.

Therefore, a need exists in the technical art for a combinatorial optimization method with favorable complexity (not exponential, but low-order polynomial) that outperforms known sub-optimal solutions, such as a nearest-car and immediate assignment algorithms.

SUMMARY

The present disclosure relates to systems and methods for scheduling elevator cars that operate according to a continuous reassignment policy until an actual time of pick up.

The embodiments of the present disclosure are based on controlling a movement of a plurality of elevator cars of the elevator system. The elevator system accepts the plurality of hall calls requesting service of the plurality of elevator cars to different floors of a building.

We realized through experimentation we needed to solve the combinatorial optimization problem of assigning N multiple passengers to C elevator cars ($C^N$ possible assignments) in the shortest time (<1s). However, we quickly learned that traditional computation methods incorporated an exhaustive search taking a very long time to compute, which because of the computationally long wait time, made such solutions impractical when put into practice. For example, we explored the Branch-and-Bound and Mixed Integer Programming (MIP) methods, which we learned both had problems because of their worst-case complexity are exponential in the number of elevator cars and halls calls. What we realized through experimentation is that we needed a combinatorial optimization method with favorable complexity (not exponential, but low-order polynomial) that outperforms known sub-optimal solutions, such as the nearest-car and immediate assignment algorithms.

We realized further that if the total waiting time for passengers was a submodular function, we could obtain a fast and close to optimal solution to group elevator scheduling, if we employed a greedy optimization algorithm.

From our experimentation, we realized the greedy optimization can produce a reasonable solution in a reasonable time, if the optimized cost function has a specific structure, e.g., quadratic, and submodular. In those cases, the greedy optimization had guaranteed performance. In contrast, the cost function of a total waiting time for passengers is neither quadratic nor submodular. What we learned is that, if we had not realized through our exhaustive experimentation, the optimized cost function structure (i.e. quadratic and submodular), then the greedy algorithm would not have been effective for optimizing AWT, since it is demonstrably a non-submodular function. Specifically, conventional greedy optimization methods can produce very suboptimal results, when applied to arbitrary objective functions. The cost function should be a total waiting time for passengers as according to our realization.

According to embodiments of the present disclosure, the systems and methods are based on our realizations that a greedy optimization algorithm of complexity $O(CN^2)$, is linear in the number of cars C and quadratic in the number of passengers N. We discovered that the success of this greedy optimization algorithm depends critically on the property of submodularity of the objective function. In the current context of optimizing average waiting time (AWT), this property is approximately equivalent to the property that when a group of passengers is picked up by the same elevator car, their cumulative waiting time is larger than the sum of their individual waiting times, if they had been picked up by multiple separate cars starting from the same location, one car per passenger. This property, unfortunately, is not strictly always true for waiting times of passengers in elevator banks, due to the intricate interplay between their positions in the pick up schedule of the car.

In order to ensure the submodular property of the objective function, the first step in at least one method is to construct an approximation of the cumulative AWT of a group of passengers that does possess the submodularity property. To this end, we use the sum of pairwise delays (SPD).

In using the Pairwise Delay Minimization, this converts the optimization problem from a general combinatorial optimization problem without any structure in the objective function to a Quadratic Binary Optimization (QBO) problem that has an objective function with very specific (quadratic) structure that can be leveraged computationally. Moreover, the objective function of the QBO problem is submodular, which allows the application of fast greedy optimization methods. We note that there is no reason to apply, or attempt in using the greedy algorithm as a mechanism to minimize the pairwise approximation, unless that person knew that the pairwise approximation was a submodular function. In fact, without having the knowledge of submodularity, which is not known, there is no reason to put together the greedy algorithm and our specific disclosed pairwise approximation.

The second step of the algorithm is to optimize the SPD by greedily assigning passengers to cars in a manner that minimizes the SPD at every step. The algorithm starts with an empty set of assignments. At every step, a new passenger is added to the set of assignments, until all passengers are assigned. This results in exactly N steps, one for every passenger. During a given step, all remaining unassigned passengers are considered in turn, and are tentatively added to each car, again in turn. For every combination of a passenger and a car, we compute the SPD of all passengers assigned so far plus the new passenger being assigned at the current step. The passenger/car combination that increases the SPD the least is chosen, the passenger is assigned to this car and removed from the list of unassigned passengers, and the algorithm proceeds with the next step.

According to an embodiment of the present disclosure, a system for controlling a movement of a plurality of elevator cars of an elevator system. The system including at least one input interface for accepting a plurality of hall calls requesting service of the plurality of elevator cars to different floors of a building. A processor in communication with the input interface is configured to determine, for each elevator car, an individual waiting time of accommodating each hall call, if the hall call is the only hall call assigned to the elevator car. Determine, for each pair of hall calls assigned for each elevator car, a pairwise delay over the individual waiting time of each hall call in the pair caused by a joint assignment of the elevator car to accommodate the pair of the hall calls. Approximate a cumulative waiting time of an assignment of the plurality of elevator cars to accommodate the plurality of hall calls as a sum of individual waiting times for accommodating each hall call with the assigned elevator car and a sum of all pairwise delays determined between all pairs of hall calls assigned to the same elevator car. Determine the assignment of the plurality of elevator cars using a greedy optimization algorithm that greedily assigns the plurality of hall calls to the plurality of elevator cars to minimize the approximated cumulative waiting time. Finally, use a controller for controlling the movement of the plurality of elevator cars according to the assignment.

According to another embodiment of the present disclosure, a method for method for scheduling elevator cars of an elevator system. The method including using at least one input interface for accepting a plurality of hall calls requesting the plurality of elevator cars to different floors of a building. Determining independently, using a processor in communication with the input interface, for each elevator car, an independent waiting time of accommodating each hall call, if the hall call is the only hall call assigned to the elevator car. Determine, for each pair of hall calls assigned for each elevator car, a pairwise delay over the individual waiting time of each hall call in the pair caused by a joint assignment of the elevator car to accommodate the pair of the hall calls. Approximating a cumulative waiting time of an assignment of the plurality of elevator cars to accommodate the plurality of hall calls as a sum of individual waiting times for accommodating each hall call with the assigned elevator car, and a sum of all pairwise delays determined for the assigned elevator car between all pairs of hall calls assigned to the same elevator car. Determine the assignment of the plurality of elevator cars using a greedy optimization algorithm that greedily assigns the plurality of hall calls to the plurality of elevator cars to minimize the approximated cumulative waiting time. Finally, using a controller for controlling the movement of the plurality of elevator cars according to the assignment.

According to another embodiment of the present disclosure, a non-transitory computer readable storage medium embodied thereon a program executable by a computer for performing a method. The method for scheduling cars of an elevator system, the elevator system including a plurality of cars, and a plurality of hall calls. The method including using at least one input interface for accepting a plurality of hall calls requesting the plurality of elevator cars to different floors of a building. Determining independently, using a process in communication with the input interface, for each elevator car, an independent waiting time of accommodating each hall call, if the hall call is the only hall call assigned to the elevator car. Determining, for each pair of hall calls assigned for each elevator car, a pairwise delay over the individual waiting time of each hall call in the pair caused by a joint assignment of the elevator car to accommodate the pair of the hall calls. Approximating a cumulative waiting time of an assignment of the plurality of elevator cars to accommodate the plurality of hall calls as a sum of individual waiting times for accommodating each hall call with the assigned elevator car, and a sum of all pairwise delays determined for the assigned elevator car between all pairs of hall calls assigned to the same elevator car. Determining the assignment of the plurality of elevator cars using a greedy optimization algorithm that greedily assigns the plurality of hall calls to the plurality of elevator cars to minimize the approximated cumulative waiting time. Finally, using a controller for controlling the movement of the plurality of elevator cars according to the assignment.

BRIEF DESCRIPTION OF THE DRAWINGS

The presently disclosed embodiments will be further explained with reference to the attached drawings. The drawings shown are not necessarily to scale, with emphasis instead generally being placed upon illustrating the principles of the presently disclosed embodiments.

Figure 1A:
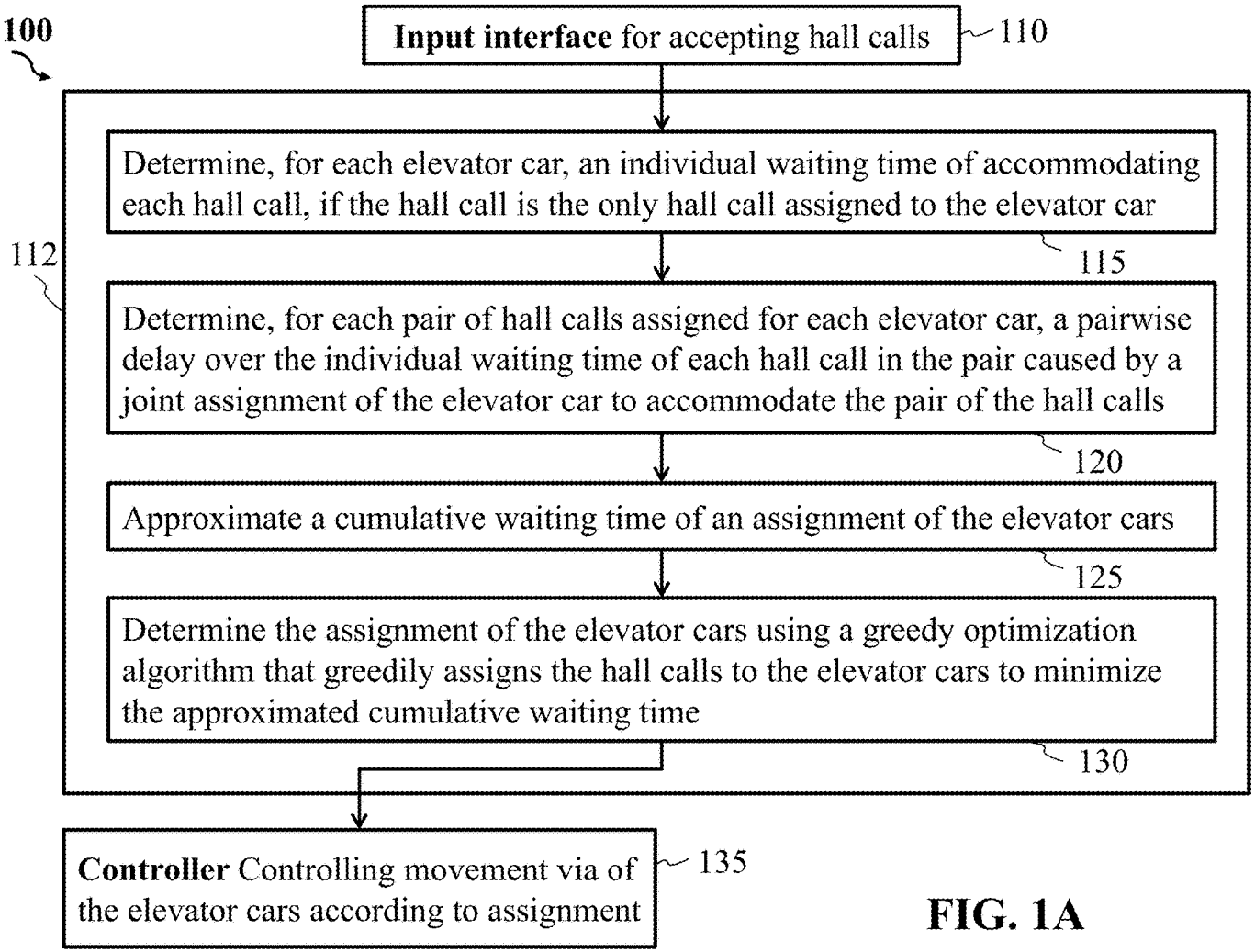
FIG. 1A is a block diagram illustrating a method for controlling a movement of a plurality of elevator cars of an elevator system, according to an embodiment of the present disclosure.

While the above-identified drawings set forth presently disclosed embodiments, other embodiments are also contemplated, as noted in the discussion. This disclosure presents illustrative embodiments by way of representation and not limitation. Numerous other modifications and embodiments can be devised by those skilled in the art which fall within the scope and spirit of the principles of the presently disclosed embodiments.

DETAILED DESCRIPTION

The following description provides exemplary embodiments only, and is not intended to limit the scope, applicability, or configuration of the disclosure. Rather, the following description of the exemplary embodiments will provide those skilled in the art with an enabling description for implementing one or more exemplary embodiments. Contemplated are various changes that may be made in the function and arrangement of elements without departing from the spirit and scope of the subject matter disclosed as set forth in the appended claims.

Specific details are given in the following description to provide a thorough understanding of the embodiments. However, understood by one of ordinary skill in the art can be that the embodiments may be practiced without these specific details. For example, systems, processes, and other elements in the subject matter disclosed may be shown as components in block diagram form in order not to obscure the embodiments in unnecessary detail. In other instances, well-known processes, structures, and techniques may be shown without unnecessary detail in order to avoid obscuring the embodiments. Further, like reference numbers and designations in the various drawings indicated like elements.

Also, individual embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process may be terminated when its operations are completed, but may have additional steps not discussed or included in a figure. Furthermore, not all operations in any particularly described process may occur in all embodiments. A process may correspond to a method, a function, a procedure, a subroutine, a subprogram, etc. When a process corresponds to a function, the function's termination can correspond to a return of the function to the calling function or the main function.

Furthermore, embodiments of the subject matter disclosed may be implemented, at least in part, either manually or automatically. Manual or automatic implementations may be executed, or at least assisted, through the use of machines, hardware, software, firmware, middleware, microcode, hardware description languages, or any combination thereof. When implemented in software, firmware, middleware or microcode, the program code or code segments to perform the necessary tasks may be stored in a machine readable medium. A processor(s) may perform the necessary tasks.

Overview

The present disclosure relates to systems and methods for scheduling elevator cars that operate according to a continuous reassignment policy until an actual time of pick up. In particular, controlling a movement of a plurality of elevator cars of the elevator system, wherein the elevator system accepts the plurality of hall calls requesting service of the plurality of elevator cars to different floors of a building.

We realized through experimentation, we needed to solve this combinatorial optimization problem of assigning N multiple passengers to C elevator cars ($C^N$ possible assignments) in the shortest time (<1 s).

During our experimentation, we quickly learned that traditional computation methods did not work, because they incorporated an exhaustive search taking a very long time to compute, i.e. computationally long wait times, that made such solutions impractical when put to use. For example, we explored the Branch-and-Bound and Mixed Integer Programming (MIP) methods, which we learned both had problems because of their worst-case complexity that are exponential in the number of elevator cars and halls calls. What we realized is we needed a combinatorial optimization method with favorable complexity (not exponential, but low-order polynomial) that outperforms known sub-optimal solutions such as the nearest-car and immediate assignment algorithms, among other things.

We further realized that greedy optimization can produce a reasonable solution in a reasonable time, if the optimized cost function has a specific structure, e.g., quadratic, and submodular. In those cases, the greedy optimization has a guaranteed performance. However, the conventional cost function of a total waiting time for passengers is neither quadratic nor submodular. Thus, without realizing the optimized cost function structure (i.e. quadratic and submodular), the greedy algorithm is not going to be effective for optimizing AWT, which is demonstrably a non-submodular function. In particular, conventional greedy optimization methods can produce very suboptimal results when operating on general objective functions. The cost function should be related to a total waiting time for passengers, as according to the present disclosure.

The systems and methods of the present disclosure are based on a greedy optimization algorithm of complexity $O(CN^2)$, that is, linear in the number of cars c and quadratic in the number of passengers N. We discovered that the success of this greedy optimization algorithm depends critically on the property of submodularity of the objective function. In the current context of optimizing average waiting time (AWT), this property is approximately equivalent to the property that when a group of passengers is picked up by the same elevator car, their cumulative waiting time is larger than the sum of their individual waiting times, if they had been picked up by multiple separate cars starting from the same location, one car per passenger. This property, unfortunately, is not strictly always true for waiting times of passengers in elevator banks, due to the intricate interplay between their positions in the pick up schedule of the car.

In order to ensure the submodular property of the objective function, the first step in our method is to construct an approximation of the cumulative AWT of a group of passengers that does possess the submodularity property. To this end, we use the sum of pairwise delays (SPD).

By using the Pairwise Delay Minimization, this converts the optimization problem from a general combinatorial optimization problem without any structure in the objective function to a Quadratic Binary Optimization (QBO) problem that has an objective function with very specific (quadratic) structure that can be leveraged computationally. Moreover, the objective function of the QBO problem is submodular, which allows the application of fast greedy optimization methods. We note that there is no reason to apply the greedy algorithm to minimize the pairwise approximation, or even think about making such a combination, since this is not known. In fact, without having the knowledge of submodularity, there is no reason to put together the greedy algorithm and our specific disclosed pairwise approximation.

The second step of the algorithm is to optimize the SPD by greedily assigning passengers to cars in a manner that minimizes the SPD at every step. The algorithm starts with an empty set of assignments. At every step, a new passenger is added to the set of assignments, until all passengers are assigned. This results in exactly N steps, one for every passenger. During a given step, all remaining unassigned passengers are considered in turn, and are tentatively added to each car, again in turn. For every combination of a passenger and a car, we compute the SPD of all passengers assigned so far plus the new passenger being assigned at the current step. The passenger/car combination that increases the SPD the least is chosen, the passenger is assigned to this car and removed from the list of unassigned passengers, and the algorithm proceeds with the next step.

Some embodiments of the present disclosure include using an input interface for accepting a plurality of hall calls requesting service of a plurality of elevator cars to different floors of a building. A processor is configured to determine, for each elevator car, an individual waiting time of accommodating each hall call, if the hall call is the only hall call assigned to the elevator car. Along with determining, for each pair of hall calls assigned for each elevator car, a pairwise delay over the individual waiting time of each hall call in the pair caused by a joint assignment of the elevator car to accommodate the pair of the hall calls.

Followed by approximating a cumulative waiting time of an assignment of the plurality of elevator cars to accommodate the plurality of hall calls, as a sum of individual waiting times for accommodating each hall call with the assigned elevator car, and a sum of all pairwise delays determined between all pairs of hall calls assigned to the same elevator car. Then, determine the assignment of the plurality of elevator cars using a greedy optimization algorithm that greedily assigns the plurality of hall calls to the plurality of elevator cars to minimize the approximated cumulative waiting time. Finally, use a controller for controlling the movement of the plurality of elevator cars according to the assignment.

FIG. 1A is a block diagram of a method for controlling a movement of a plurality of elevator cars of an elevator system, according to an embodiment of the present disclosure. The method 100 includes step 110 of using at least one input interface for accepting a plurality of hall calls requesting the plurality of elevator cars to different floors of a building. Such an interface is located at every elevator landing in the building. It is contemplated that the plurality of hall calls may be accepted. The most typical user interface includes an up button and a down button, which are used by the passenger to request transportation in the respective direction. A more novel user interface, known as a destination panel, includes buttons for all possible destination floors. A combination between the two types of interfaces is also possible, for example a full destination panel at the lobby of the building and a simpler two-button interface at other floors.

Step 115 of FIG. 1A includes determining independently, using a processor 112 in communication with the input interface, for each elevator car, an independent waiting time of accommodating each hall call, if the hall call is the only hall call assigned to the elevator car. In practice, this determining is done by means of an internal simulator that simulates the path of the car if it has to pick up this passenger only. Note that any outstanding car calls places by passengers already in the car must be included in the simulation. For example, if the car is at the $3^{rd}$ floor, and the hall call is at the $8^{th}$ floor, but there is an outstanding car call to the $5^{th}$ floor, the stop at the $5^{th}$ floor must be simulated, too.

Step 120 of FIG. 1A includes determining, for each pair of hall calls assigned for each elevator car, a pairwise delay over the individual waiting time of each hall call in the pair caused by a joint assignment of the elevator car to accommodate the pair of the hall calls. In practice, this determining is done by means of an internal simulator that simulates the path of the car if it has to pick up these two passengers only, according to the preferred pick-up order for this elevator bank. The usual method of deciding the pick-up order is the group collective policy, where the car picks up all passengers in front of it in its current direction of motion, going in the same direction, then reverses direction to pick up all passengers going in the opposite direction, and finally reverses direction again to pick up passengers going in its original direction, but behind its starting floor. Other pick-up sequencing policies are also possible, and can be simulated similarly. After the simulation is complete, the increase in waiting times of the two passengers are computed with respect to their individual waiting times determined in step 115. The sum of these increases is the pairwise delay between the two hall calls. Note that in all cases, only one of these increases is greater than zero, and the other one is always zero.

Step 125 of FIG. 1A includes approximating a cumulative waiting time of an assignment of the plurality of elevator cars to accommodate the plurality of hall calls as a sum of individual waiting times $w_i^c$ for accommodating each hall call i with its assigned elevator car c, and a sum of all pairwise delays $w_{ij}^c$ between all pairs of hall calls (i,j) assigned to the same elevator car c, according to the formula $$Q(x) = \sum_{i=1}^{N}\sum_{c=1}^{C} w_i^c x_i^c + \sum_{i=1}^{N}\sum_{j=i+1}^{N}\sum_{c=1}^{C} w_{ij}^c x_i^c x_j^c,$$

where the indicator variable $x_i^c=1$ if hall call i is assigned to car c, and $x_i^c=0$ otherwise.

Step 130 of FIG. 1A includes determining the assignment of the plurality of elevator cars using a greedy optimization algorithm that greedily assigns the plurality of hall calls to the plurality of elevator cars to minimize the approximated cumulative waiting time.

As noted above, the greedy optimization algorithm has a complexity $O(CN^2)$, that is, linear in the number of cars c and quadratic in the number of passengers N. Such that the success of this greedy optimization algorithm depends critically on the property of submodularity of the objective function. Further, when optimizing average waiting time (AWT), this property is approximately equivalent to the property that when a group of passengers is picked up by the same elevator car, their cumulative waiting time is larger than the sum of their individual waiting times, if they had been picked up by multiple separate cars starting from the same location, one car per passenger.

Step 135 of FIG. 1A includes using a controller for controlling the movement of the plurality of elevator cars according to the assignment. Once the schedule has been determined, each car starts serving the hall calls assigned to it, according to the accepted sequence discussed above.

Figure 1B:
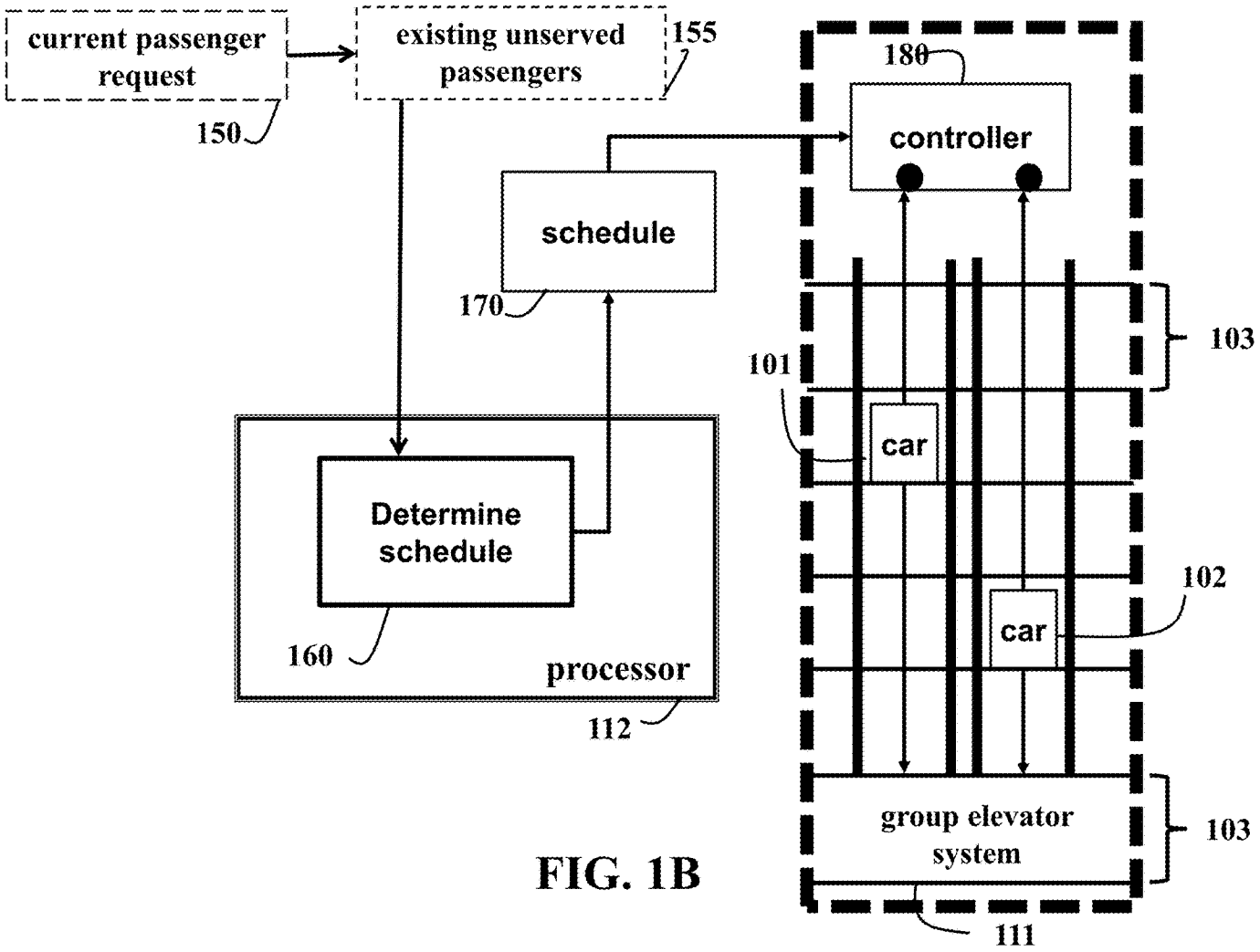
FIG. 1B is a schematic illustrating the method of FIG. 1A, for scheduling hall calls from passengers regarding controlling movement of the plurality of elevator cars of an elevator system, according to embodiments of the present disclosure.

FIG. 1B is a schematic illustrating the method of FIG. 1A, for scheduling elevator cars 101-102 in a group elevator system 111 in a building having multiple floors 103, according to embodiments of the present disclosure. The controller keeps track of all requests for service, in the form of a table of hall calls 155. When a hall call is served by a car that picks up the passenger or passengers that initiated the call, that hall call is removed from the table 155. When a new hall call 150, is registered, it is added to the table 155. At regular intervals, or at specific events, such as new hall calls or starts/stops of cars at floors, the scheduler 160 is executed. It produces a schedule 170 in the form of a full assignment of all outstanding hall calls to cars. The controller 180 continuously executes the current schedule 170, according to the preferred service policy, for example the group collective service policy, also known as the selective collective principle, or some other policy, Tanaka, Uraguchi, and Araki, Dynamic optimization of the operation of single-car elevator systems with destination hall call registration: Part I. Formulation and simulations, European Journal of Operational Research 167.2 (2005), pp 550-573

Figure 1C:
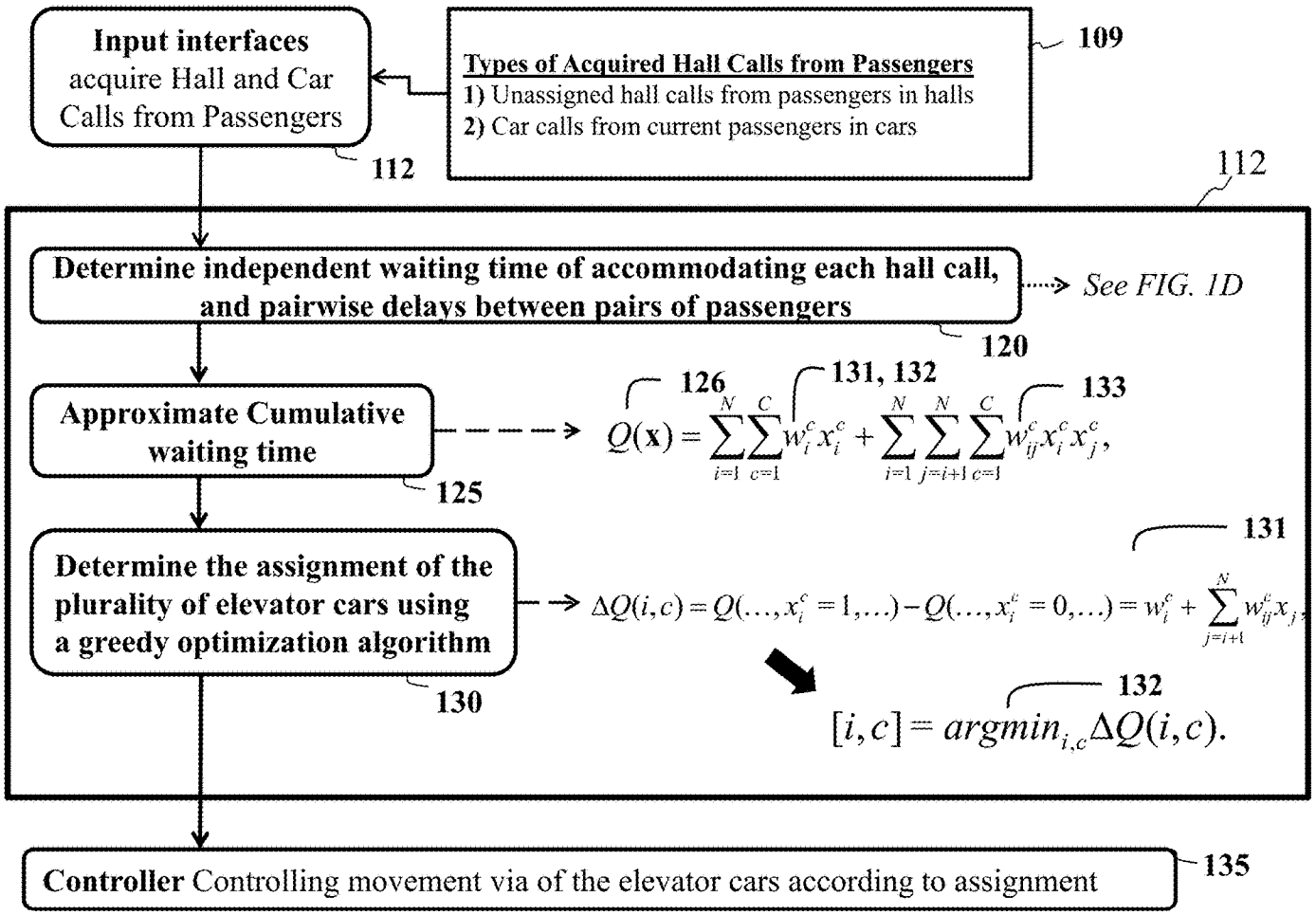
FIG. 1C is a flow diagram of the method of FIG. 1A, for controlling a movement of a plurality of elevator cars of an elevator system, according to embodiments of the present disclosure.

FIG. 1C is a flow diagram of the method of FIG. 1A, for controlling a movement of a plurality of elevator cars of an elevator system, according to embodiments of the present disclosure. The controller collects information about hall calls 109 from the up/down button interfaces 112 located at each elevator landing, and car calls 109 from button panel interfaces 112 located in each car; determines (step 120) independent waiting time of accommodating each hall call, and pairwise delays between pairs of passengers constructs (step 125) an approximate cumulative waiting time 126 in the form of a quadratic Boolean function; determines (step 130) the assignment of the plurality of elevator cars using a greedy optimization algorithm by executing N assignment steps, such that at each step the marginal increase in waiting time 131 among all passengers that are not assigned yet is minimized 132; and executes the current schedule according to the current assignment, until the next reassignment step. Finally, step 135 includes using a controller for controlling the movement of the plurality of elevator cars according to the assignment.

Figure 1D:
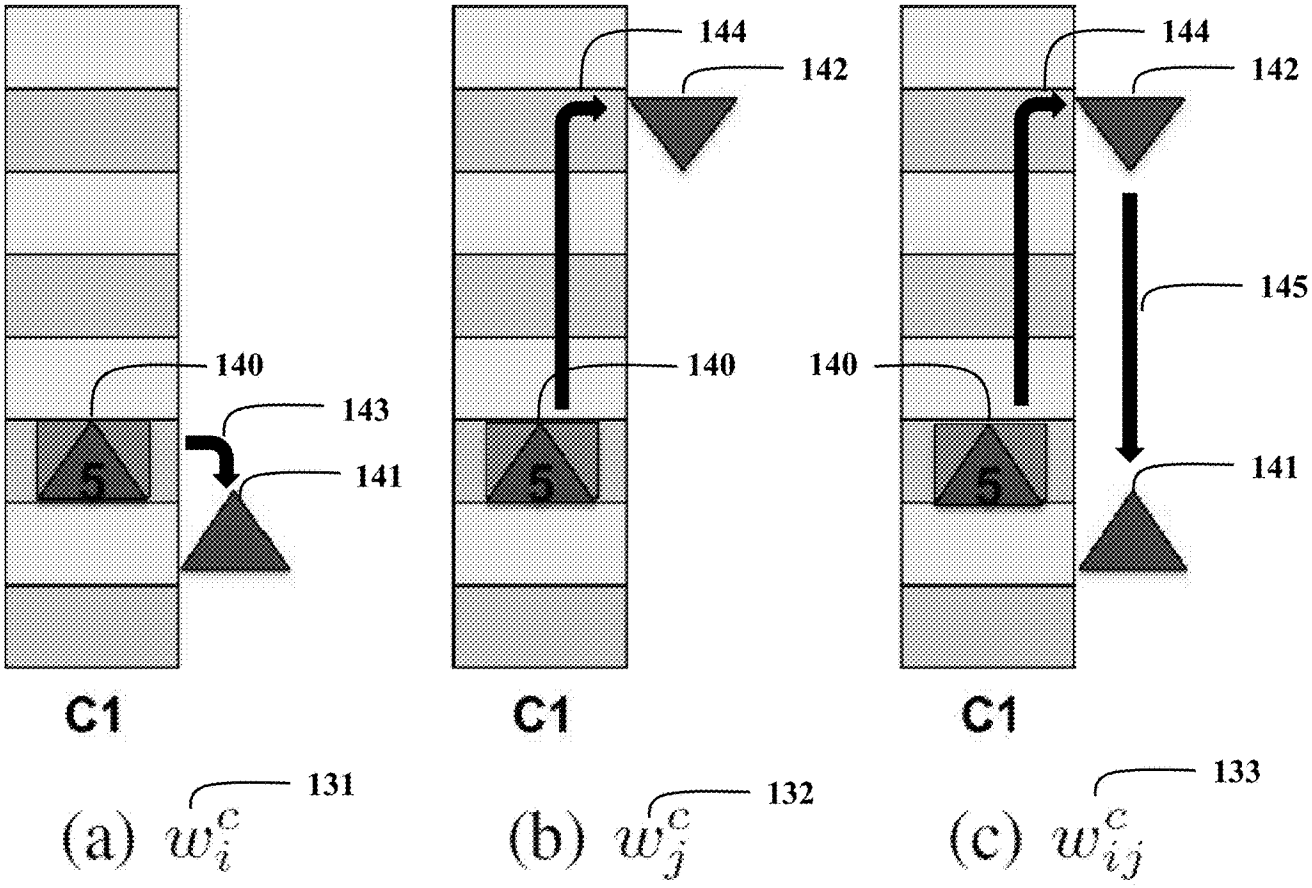
FIG. 1D is a schematic illustrating the computation of unary and pairwise terms of step 120 of FIG. 1C, according to embodiments of the present disclosure.

FIG. 1D is a schematic illustrating the computation of unary and pairwise terms of step 120 of FIG. 1C, according to embodiments of the present disclosure. In FIG. 1D, the individual waiting times (unary terms) and mutual delays (pairwise terms) are computed for two passengers 141 and 142 to be picked up by the same car 140 (C1, currently at the $5^{th}$ floor, and moving up). In FIG. 1D-a, the car will reverse its direction and quickly pick up 143 the first passenger from the floor below. The resulting waiting time will be the unary term 131 for the first passenger 141. This time can be computed by means of forward simulation of what the car will do when picking up that passenger. In FIG. 1D-b, through a similar simulation, it will be determined that the car will continue its direction of motion and pick up 144 the second passenger 142. The resulting waiting time of that passenger 142 will be his unary term 132. Finally, in FIG. 1D-c, it is determined that if the car 140 is to pick up both passengers 141 and 142, following the principle of group collective control, it will first pick up 144 the second passenger 142, as in FIG. 1D-b, and only then will it reverse direction to come down 145 and pick up the first passenger 141. As a result, the first passenger 141 will wait much longer for service than if he was picked up alone, as in FIG. 1D-a. This difference in the waiting time of passenger 141 between cases 1D-c and 1D-a is the delay the second passenger 142 would cause to passenger 141, and is equal to the pairwise delay term 133 between these two passengers. Note that for each pair of passengers, only one of them is delaying the other, but not vice versa; in FIG. 1D, passenger 142 is delaying passenger 141, but passenger 142 is not delayed by passenger 141, specifically for this car 140 in its current direction of motion. For a different car, the delay might be different.

Figure 2:
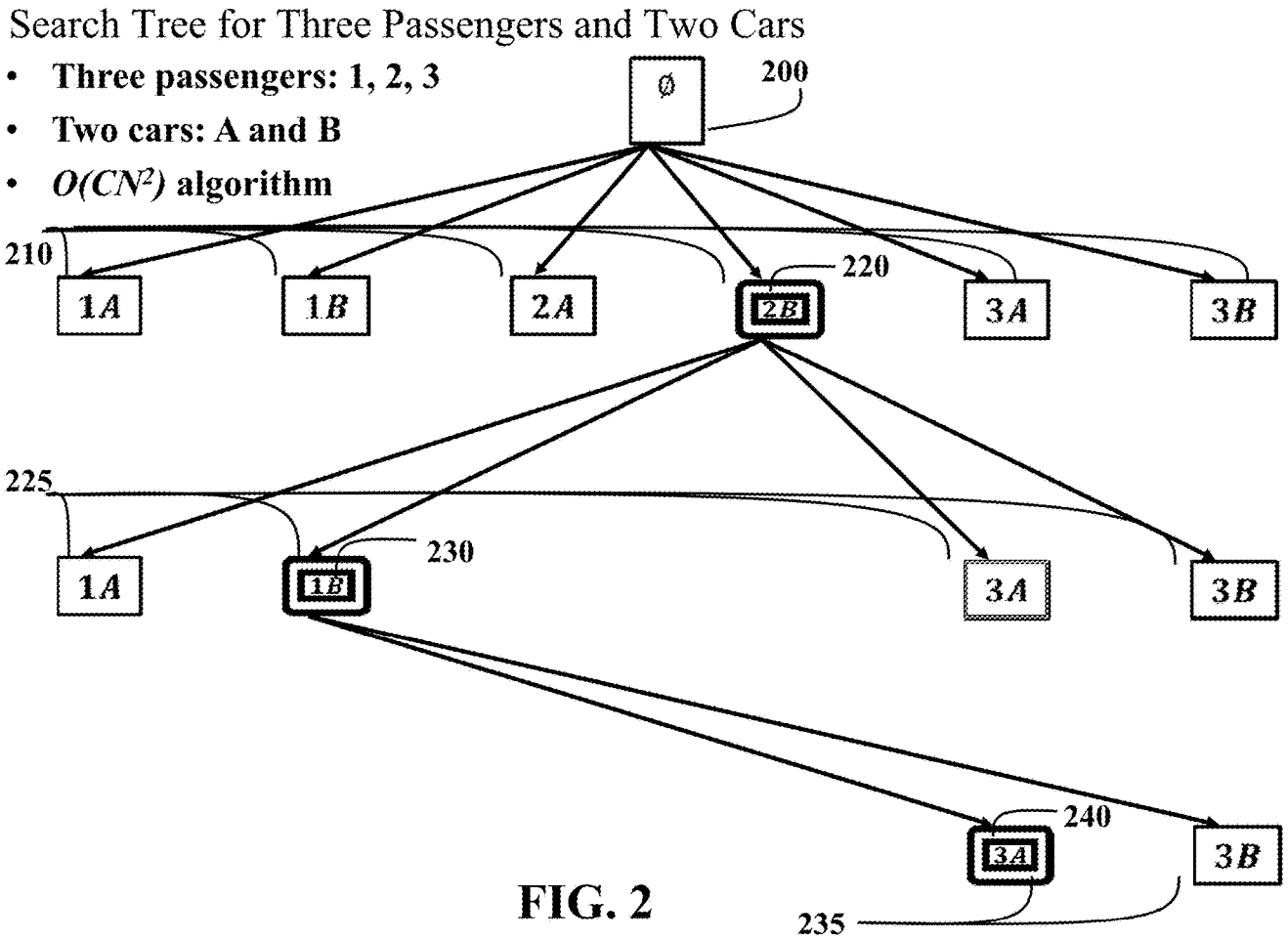
FIG. 2 shows the search tree of the greedy optimization algorithm for a reassignment problem with N=3 passengers (1, 2, and 3) and two cars (A and B), where each level of the tree corresponds to one assignment step of the algorithm, according to embodiments of the present disclosure.

FIG. 2 shows the search tree of the greedy optimization algorithm for a reassignment problem with N=3 passengers (1, 2, and 3) and two cars (A and B), where each level of the tree corresponds to one assignment step of the algorithm. The root node of the tree 200 corresponds to the initial stage of the algorithm, when no assignments have been made yet. Six tentative assignments 210 are made of the three unassigned calls to the two available cars. For each of them, the marginal increase in waiting time 131 is computed and the minimum 132 is determined. In this example, this minimum 132 is achieved for the pair 220 of call 2 and car B (2B). Passenger 2 is assigned to car B, all other tree nodes at this level are ignored, and the children nodes of node 2B (220) are expanded at the next level, with the remaining four possible assignments 225 between the remaining unassigned passengers 1 and 3 and the two available cars A and B. The marginal increase in waiting time 130 is computed for each of these tentative assignments, keeping in mind that passenger 2 has already been assigned to car B, so any other passenger assigned to car B would either delay or be delayed by passenger 2, according to the respective pairwise term 133. At this level, the assignment 1B 230 is determined to increase the waiting time the least, so it is chosen among the four 225. At the next, final stage 235, the only remaining passenger 3 is assigned analogously 240 to car A, because it results in a lower marginal increase in waiting time than the alternative, 3B.

The algorithm has two main stages: the first one is the computation of the approximation of AWT based on the sum of pairwise delays (SPD), and the second one is the greedy optimization algorithm for optimizing the SPD in N steps, where N is the number of passengers still waiting to be picked up at the time of reassignment.

Stage 1: Quadratic Boolean Approximation

During the first stage, two sets of coefficients $w_i^c$ and $w_{ij}^c$ are computed to construct a quadratic Boolean approximation of the cumulative waiting time of the entire set of passengers currently waiting for service at the time when reassignment is performed, in the form:

$$Q(x) = \sum_{i=1}^{N}\sum_{c=1}^{C} w_i^c x_i^c + \sum_{i=1}^{N}\sum_{j=i+1}^{N}\sum_{c=1}^{C} w_{ij}^c x_i^c x_j^c, \tag{1}$$

where $x_i^c$ is an indicator variable which takes on a value of 1 when passenger i is assigned to car c, and 0 otherwise. All N·C indicator variables can be collected in a decision vector $x=[x_1^1, x_2^1, \ldots, x_N^1, x_1^2, x_2^2, \ldots, x_N^2, \ldots, x_1^C, x_2^C, \ldots x_N^C]$. The procedure is detailed in U.S. Pat. No. 7,546,905, Nikovski et al., System and method for scheduling elevator cars using pairwise delay minimization, incorporated herein and thereafter in its entirety. The procedure is repeated below using a slightly different notation.

Let H be the set of N passengers $\{h_1, h_2, \ldots, h_N\}$ still waiting. A single passenger $h_i$ is described by the tuple $(t_i, o_i d_i)$, where $t_i$ is the arrival time, $o_i$ is the arrival floor, and $d_i$ is the indicated direction of movement, or the desired destination floor, if known. A full assignment of the N passengers to the C cars in a bank would be a partition of H into C subsets $H_c$, such that $H=H_1 \cup H_2 \cup \ldots \cup H_C$, and $H_i \cap H_j = \emptyset$ if $i \neq j$. Let also $W_c(h|A)$, where h is a passenger and A is a set of passengers, denote the expected waiting time of passenger h if assigned to car c (as it is in its current position), and also all passengers in the set A are assigned to the same car c , too. Note that this waiting time reflects all constraints that already exist for car c , including stops requested by passengers who are already inside the car, and have indicated their destination floor by pressing one of the buttons on the destination panel inside the car.

The expected waiting time $W_c(h|A)$ can be computed relatively easily by performing a forward simulation of the path of car c until the time it picks up passenger h , while also stopping to unload passengers already in it, or picking up other passeners in the set A that need to picked up before passenger h. Such a simulation supposes that a specific predetermined order of servicing hall and car calls will be followed by the schedule execution system of the elevator bank. The usual order adopted by most actual elevator systems, commonly called the group collective policy, is to service all car and hall calls in the current direction of motion of the car, then reverse its direction, and repeat the procedure in alternating directions indefinitely. However, in practice, any order can be followed, as long as it is known in advance, fixed, and can be simulated in software.

Then, the coefficients in the quadratic Boolean approximation shown in Equation 1 can be computed as follows:

$$w_i^c = W_c(h_i|\{h_i\}) \tag{2}$$

$$w_{ij}^c = [W_c(h_i|\{h_i, h_j\}) - W_c(h_i|\{h_i\})] + [W_c(h_i|\{h_i, h_j\}) - W_c(h_j|\{h_j\})]. \tag{3}$$

Per Equation 2, the linear coefficient $w_i^c$ is simply the expected waiting time of passenger $h_i$, if that passenger is picked by car c, and no other passenger is picked up by that car. In order to compute the N·C linear coefficients $w_i^c$, a total of N·C forward simulations must be performed, from the current position of each car to the floor of each passenger. These simulations are very simple and usually very fast.

Per Equation 3, the bilinear coefficient $w_{ij}^c$ is equal to the mutual delay between passengers $h_i$ and $h_j$. For a specific pick-up order of passengers by car c, only one of the two passengers is causing a delay to the other. (The passenger who will picked up first causes a delay for the passenger who will be picked up second.) In order to compute this delay, we compute the two differences $W(h_i|\{h_i, h_j\}) - W_c(h_i|\{h_i\})$ and $W_c(h_i|\{h_i, h_j\}) - W_c(h_j|\{h_j\})$, only one of which is zero. In practice, the two values $W(h_i|\{h_i, h_j\})$ and $W_c(h_i|\{h_j\})$ can be computed by means of only one forward simulation, where car c picks up both passengers $h_i$ and $h_j$, and their respective waiting times are calculated. The other two values, $W_c(h_i|\{h_i, h_j\})$ and $W_c(h_j|\{h_j\})$, have been computed during the calculation of the linear coefficients, and could be stored during that step for reuse. In total, the computation of the N(N−1)C/2 bilinear coefficients requires an equal number of forward simulations, one for every car and every pair of passengers. These simulations are also relatively simple and very fast.

Stage 2: Greedy Optimization of Approximated Waiting Time

After the coefficients of the approximation Q(x) have been computed, the optimal assignment x* must be computed as $x^* = \mathrm{argmin}_x Q(x)$, subject to the constraints that the decision variables are Boolean (i.e., they assume values of only 0 or 1), and exactly one decision variable is equal to 1 for a given passenger ($\Sigma_{c=1}^{C} x_i^c = 1$).

Equation 1 can be recognized as a quadratic expression in the decision variables $x_i$, which, along with the requirement for these variables to assume Boolean values, turns the minimization task into a Quadratic Boolean Optimization (QBO) problem. Even though the problem possesses a certain mathematical structure, it is well known that it is NP-complete, that is, finding its truly optimal solution will still have exponential complexity $O(C^N)$ using any known optimization algorithm. However, the particular version of the problem we are considering has an additional property. Let us define the set function $f(S)=-Q(x)$, whose argument is one of the possible subsets of all assignments $(h_i \rightarrow c)$ of passengers to cars, (including incomplete assignments where not all passengers are assigned), such that $x_i^x=1$ if $(h_i \rightarrow c) \in S$, and $x_i^c=0$, otherwise. Then, it can be proven that the function $f(S)$ is submodular, that is, for two sets of assignments $S_1 \subseteq S_2$, and an element (assignment) $s \notin S_2$ it is true that $$f(S_1 \cup s)-f(S_1) \geq f(S_2 \cup s)-f(S_2).$$

This is true because the function $f$ is the negative of the function Q, and adding a passenger to a larger set of passengers already assigned to the same car would result in a larger increase in cumulative waiting time in comparison to the case when the same passenger is added to a smaller set of passengers. The latter is true because more mutual delays exist in a larger group of passengers than in a smaller one.

Because the function $f$ is the negative of the function Q, maximizing $f$ is equivalent to minimizing Q, which is our goal. But, when a function is submodular, a type of greedy optimization algorithm can be applied to maximize it, with provable performance guarantees, Nemhauser, G. L.; Wolsey, L. A.; and Fisher, M. L. 1978. An analysis of the approximations for maximizing submodular set functions, Mathematical Programming, pp. 265-294. That is, the algorithm has a very favorable computational complexity $(O(N^2C))$, while the minimal value it returns is guaranteed to be within double the true minimum. (In practice, the suboptimality is often much smaller.)

The algorithm has exactly N steps, and at every step, one passenger is assigned to a car. The algorithm starts with an empty set of assignments. At every step n, n=1, . . . , N, all remaining N−n+1 unassigned passengers in the set $H_n^-$ are tentatively assigned to one of the C cars. If passenger $h_i$ is being tentatively assigned to car c, the increase $\Delta Q(i,c)$ of the total waiting time of all passengers, including the new passenger $h_i$, can be defined and computed as $$\Delta Q(i, c) = Q(\ldots\ , x_i^c = 1, \ldots) - Q(\ldots\ , x_i^c = 0, \ldots) = w_i^c + \sum_{j=i+1}^{N} w_{ij}^c x_j,$$

that is, we tentatively set the value of $x_i^c$ to 1, and compute the increase in Q(x), while keeping all other assignments as they currently are. This increase will include the time $w_i^c$ it would take the car c to pick up passenger $h_i$ if it had no other passengers to pick up, plus the marginal increase of waiting times for all passengers already assigned to the same car, caused by the new passenger, or the marginal time those passengers would cause to the new passenger, if only they and the new passengers are being transported by the same car. Clearly, the waiting times of passengers assigned to other cars would not be affected by this tentative assignment.

Then, the algorithm selects the assignment with the smallest increase in cumulative waiting time:

$$[i, c]=\text{argmin}_{i,c}\Delta Q(i,c).$$

After the last, N-th step of the algorithm, a full assignment of passengers to cars has been constructed.

FIG. 2 shows the search tree of this algorithm, for the case when 3 passengers, 1, 2, and 3, need to be assigned to 2 cars, A and B . The algorithm starts with an empty set of assignments 200. During the first step, all three passengers are yet to be assigned. The six possible assignments 1A, 1B, 2A, 2B, 3A, and 3B are tentatively tested. Since no passengers have been assigned previously, the increases in marginal waiting times are simply the respective times it would take for the car to pick up the passenger alone. It turns out that passenger 2 will be picked up by car B the fastest, so this is the assignment 220 chosen at this step. Note that this is a greedy assignment, and will never be revised later.

During the second step, the two remaining passengers, 1 and 3 are tentatively assigned to the two cars A and B. If they are assigned to car B, which has already been determined to transport passenger 2, the mutual delay between the new passenger and passenger 2 needs to be added to the increase in cumulative waiting time, too. In this example, it is concluded 230 that it is actually less expensive to assign passenger 1 to car B, too, even if the mutual delay between passengers 1 and 2 must be added, rather than assign this passenger to car A, or assign passenger 3 to either car. This could be because passengers 2 and 1 are unusually close to car B.

And, in the last step, the remaining passenger 3 is assigned 240 to car A, because it would result in lower waiting time than if the passenger was assigned to car B. This assignment is quite logical, because by this stage, car B is already scheduled to pick up passengers 1 and 2, and if it were to also pick up passenger 3, the entire system would have to incur the mutual delay between each pair of passengers, while car A would be idle; clearly, this is not likely to be the most optimal solution.

Note that the order of assignment of passengers to cars is not fixed, and that is the main difference of the proposed algorithm with respect to the immediate assignment method, where the order of assignment is fixed and identical to the chronological order of arrival of passengers. The computational cost of the proposed method is slightly higher—at each one of the N steps, on the order of N remaining passengers are tentatively assigned to the C cars, for a computational complexity of $O(N^2C)$. This is one polynomial degree higher than the complexity of the immediate assignment method (O(NC)), but still very much within the computational power of most modem microcontrollers.

Figure 3:
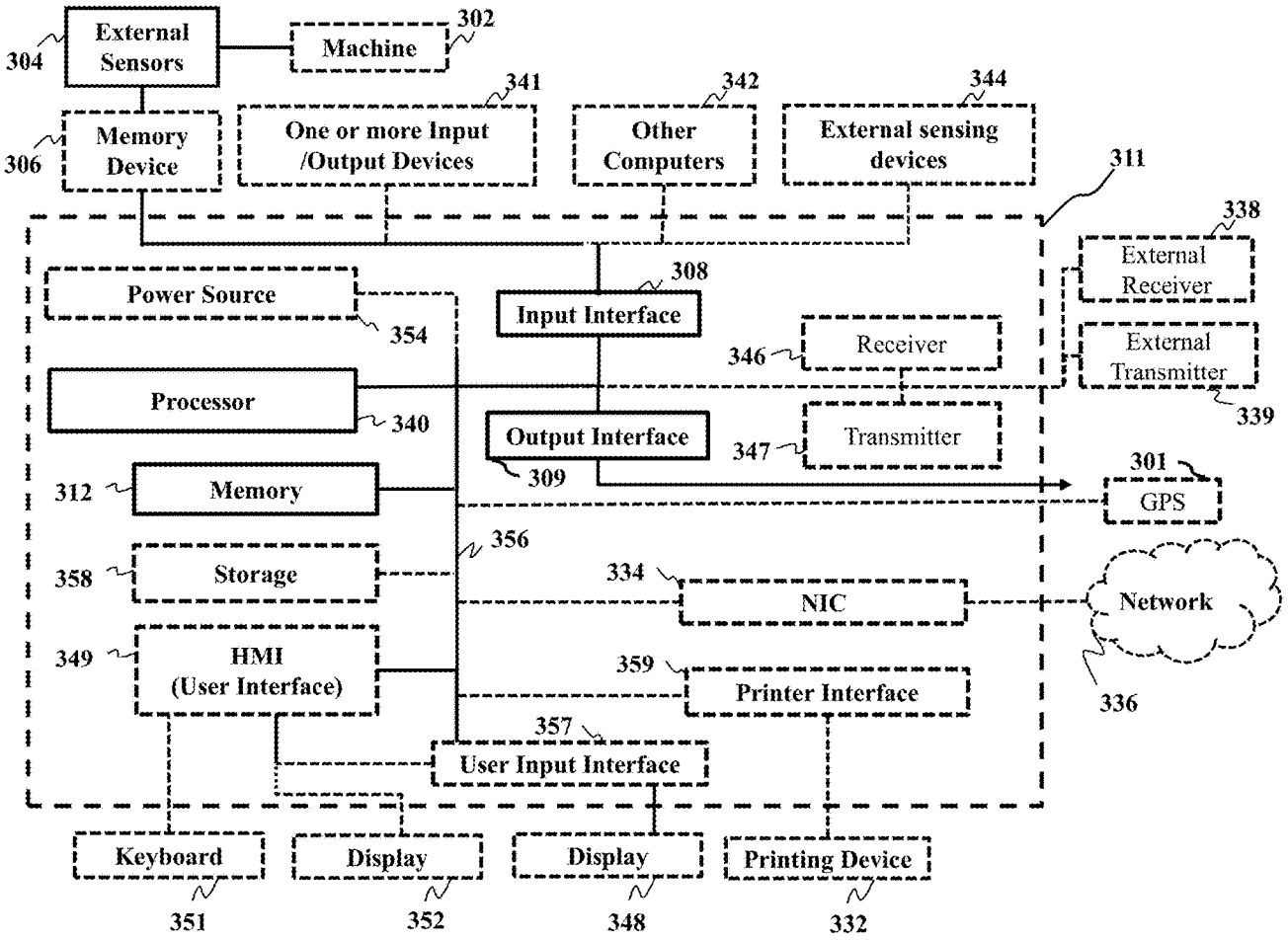
FIG. 3 is a block diagram of illustrating the method of FIG. 1A, that can be implemented using an alternate computer or processor, according to embodiments of the present disclosure.

FIG. 3 is a block diagram of illustrating the method of FIG. 1A, that can be implemented using an alternate computer or processor, according to embodiments of the present disclosure. The computer 311 includes a processor 340, computer readable memory 312, storage 358 and user interface 349 with display 352 and keyboard 351, which are connected through bus 356. For example, the user interface 349 in communication with the processor 340 and the computer readable memory 312, acquires and stores the data (i.e., data relating to controlling movement of the elevator cars or elevator systems, elevator system operational historical data, elevator system optimization related data related to assigning halls calls to elevator cars of a similar elevator system), in the computer readable memory 312 upon receiving an input from a surface, keyboard surface, of the user interface 357 by a user.

Contemplated is that the memory 312 can store instructions that are executable by the processor, historical data, and any data to that can be utilized by the methods and systems of the present disclosure. The processor 440 can be a single core processor, a multi-core processor, a computing cluster, or any number of other configurations. The processor 340 can be connected through a bus 356 to one or more input and output devices. The memory 312 can include random access memory (RAM), read only memory (ROM), flash memory, or any other suitable memory systems.

Still referring to FIG. 3, a storage device 358 can be adapted to store supplementary data and/or software modules used by the processor. For example, the storage device 358 can store historical data and other related data such as manuals for the devices of the elevator system or similar types of elevator systems, wherein the devices can include sensing devices capable of obtaining data as mentioned above regarding the present disclosure. Additionally, or alternatively, the storage device 358 can store historical data similar to the data. The storage device 358 can include a hard drive, an optical drive, a thumb-drive, an array of drives, or any combinations thereof.

The system can be linked through the bus 356 optionally to a display interface (not shown) adapted to connect the system to a display device (not shown), wherein the display device can include a computer monitor, camera, television, projector, or mobile device, among others.

The computer 311 can include a power source 354, depending upon the application the power source 354 may be optionally located outside of the computer 311. Linked through bus 356 can be a user input interface 357 adapted to connect to a display device 348, wherein the display device 348 can include a computer monitor, camera, television, projector, or mobile device, among others. A printer interface 359 can also be connected through bus 356 and adapted to connect to a printing device 332, wherein the printing device 332 can include a liquid inkjet printer, solid ink printer, large-scale commercial printer, thermal printer, UV printer, or dye-sublimation printer, among others. A network interface controller (NIC) 334 is adapted to connect through the bus 356 to a network 336, wherein measuring data or other data, among other things, can be rendered on a third party display device, third party imaging device, and/or third party printing device outside of the computer 311.

Still referring to FIG. 3, the data or other data, among other things, can be transmitted over a communication channel of the network 336, and/or stored within the storage system 358 for storage and/or further processing. Further, the measuring data or other data may be received wirelessly or hard wired from a receiver 346 (or external receiver 338) or transmitted via a transmitter 347 (or external transmitter 339) wirelessly or hard wired, the receiver 346 and transmitter 347 are both connected through the bus 356. The computer 311 may be connected via an input interface 308 to external sensing devices 344 and external input/output devices 341. The computer 311 may be connected to other external computers 342. An output interface 309 may be used to output the processed data from the processor 340.

According to aspects of the present disclosure, the greedy optimization algorithm is an algorithmic paradigm that determines at an initial step, an assignment of an unassigned first hall call, based on a locally optimal choice determined at a time of the initial step, then proceeds to the next step or the next successive unassigned hall call. According to aspects of the present disclosure, the locally optimal choice identifies at each step, a combination of an unassigned hall call from all the remaining unassigned hall calls and an elevator car from the plurality of elevator cars, that results in a least increase in a waiting time for all assigned hall calls including the first hall call, while considering all previous assigned hall calls, then the combination is accepted and the hall call is assigned without further consideration and removed from all the remaining unassigned hall calls.

According to aspects of the present disclosure, the greedy optimization algorithm starts with an empty set of assignments of hall calls needing to be assigned, such that at every step including an initial step which starts with a first hall call, is added to the set of assignments of hall calls needing to be assigned, so as to result in a total of N steps, until all unassigned hall calls are assigned. Wherein each step in the total of N steps includes a hall call for every passenger to be moved between floors of the building, such that during each step, an unassigned hall call from a passenger is considered sequentially in time, and is initially added to an elevator car of the plurality of elevator cars successively. Wherein for every combination of the hall call and the elevator car, the greedy optimization algorithm computes a cumulative waiting time of all hall calls assigned at that moment in time, plus the first hall call assigned at the initial step. Wherein the hall call and the elevator car combination having a least increase in the cumulative waiting time for all assigned hall calls including the first hall call of the initial step, the combination is accepted, and the hall call is assigned and removed from all the remaining unassigned hall calls, then continues to the next step or the next successive unassigned hall call.

According to aspects of the present disclosure, wherein the greedy optimization algorithm is based on optimizing the approximated cumulative waiting time in N steps, where N is a number of unassigned hall calls from passengers waiting to be assigned at a time at each step, such that two sets of coefficients are computed to construct a quadratic Boolean approximation of the cumulative waiting time of all the plurality of hall calls from passengers currently waiting to be assigned at the time of that step. Wherein the first set of coefficients of the two sets of coefficients includes $w_i^c$, such that $w_i^c$ is a linear coefficient that is an expected waiting time of a hall from a passenger $h_i$, if the hall call is picked by an elevator car c, and no other hall call is picked up by that elevator car.

According to aspects of the present disclosure, wherein the second set of coefficients of the two sets of coefficients includes $w_{ij}^c$, such that $w_{ij}^c$ is a bilinear coefficient that is equal to the pairwise delay between hall calls from passengers $h_i$ and $h_j$, based on a specific pick-up order of the two hall calls by the elevator car c, such that only one of the two hall calls is causing a delay to the hall call, and the hall call that is picked-up first causes a delay for the hall call that is picked-up second.

According to aspects of the present disclosure, wherein the cumulative waiting time is determined according to $$Q(x)B\sum_{i=1}^{N}\sum_{c=1}^{C}w_i^c x_i^c + \sum_{i=1}^{N}\sum_{j=i+1}^{N}\sum_{c=1}^{C}w_{ij}^c x_i^c x_j^c,$$

where $x_i^c$ is an indicator variable which takes on a value of 1 when the hall call from the passenger i is assigned to the elevator car c, and 0 otherwise, and that all N·C indicator variables are collected in a decision vector $x=[x_1^1, x_2^1, \ldots, x_N^1, x_1^2, x_2^2, \ldots, x_N^2, \ldots, x_1^C, x_2^C, \ldots, x_N^C]$.

According to aspects of the present disclosure, Wherein the greedy optimization algorithm includes a $O(CN^2)$, that is, linear in a number of elevator cars C and quadratic in a number of hall calls by passengers N, and includes a property of submodularity of an objective function. Wherein for each step, all remaining unassigned hall calls by passengers are considered sequentially in time, and are initially added to each elevator car successively, and for every combination of a hall call and an elevator car, the SPD of all hall calls assigned, plus the new hall call assigned at the initial step are then calculated, and any combination of the hall call initially added with the elevator car that increases the SPD least, then the hall call is assigned to that elevator car, and removed all the remaining unassigned hall calls, and then continues to the next step.

According to aspects of the present disclosure, historical elevator system data originates from a user, and is stored in a memory in communication with the processor. The historical elevator system data can be data relating to elevator systems including similar elevator systems of the present disclosure, as well as instructional data According to aspects of the present disclosure, further comprising: initiating to start to implement the method by accepting the hall call data and to be received by the input interface is by a user input provided on a surface of at least one user input interface in communication with the processor and received by the processor According to aspects of the present disclosure, further comprising: using a user input provided on a surface of at least one user input interface both in communication with the processor and received by the processor via the input interface for controlling movement of the plurality of elevators based upon an abnormal event. The abnormal event can include an event that disrupts operation of the plurality of elevators causing an unsafe environment to cargo and passengers on the elevators The above-described embodiments of the present disclosure can be implemented in any of numerous ways. For example, the embodiments may be implemented using hardware, software or a combination thereof. Use of ordinal terms such as "first," "second," in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements Although the present disclosure has been described with reference to certain preferred embodiments, it is to be understood that various other adaptations and modifications can be made within the spirit and scope of the present disclosure. Therefore, it is the aspect of the append claims to cover all such variations and modifications as come within the true spirit and scope of the present disclosure.

What is claimed is:

1. A system for controlling a movement of a plurality of elevator cars of an elevator system, comprising:

at least one input interface for accepting a plurality of hall calls requesting service of the plurality of elevator cars to different floors of a building;

a processor in communication with the input interface is configured to determine, for each elevator car, an individual waiting time of accommodating each hall call, if the hall call is the only hall call assigned to the elevator car;

determine, for each pair of hall calls assigned to each elevator car, a pairwise delay over the individual waiting time of each hall call in the pair caused by a joint assignment of the elevator car to accommodate the pair of the hall calls;

approximate a cumulative waiting time of an assignment of the plurality of elevator cars to accommodate the plurality of hall calls as a sum of individual waiting times for accommodating each hall call with the assigned elevator car, and a sum of all pairwise delays determined between all pairs of hall calls assigned to the same elevator car; and determine the assignment of the plurality of elevator cars using a greedy optimization algorithm that greedily assigns the plurality of hall calls to the plurality of elevator cars to minimize the approximated cumulative waiting time; and a controller for controlling the movement of the plurality of elevator cars according to the assignment.

2. The system of claim 1, wherein the greedy optimization algorithm is an algorithmic paradigm that determines at an initial step, an assignment of an unassigned first hall call, based on a locally optimal choice determined at a time of the initial step, then proceeds to the next step or the next successive unassigned hall call.

3. The system of claim 2, wherein the locally optimal choice identifies at each step, a combination of an unassigned hall call from all the remaining unassigned hall calls and an elevator car from the plurality of elevator cars, that results in a least increase in a waiting time for all assigned hall calls including the first hall call, while considering all previous assigned hall calls, then the combination is accepted and the hall call is assigned without further consideration and removed from all the remaining unassigned hall calls.

4. The system of claim 1, wherein the greedy optimization algorithm starts with an empty set of assignments of hall calls needing to be assigned, such that at every step including an initial step which starts with a first hall call, is added to the set of assignments of hall calls needing to be assigned, so as to result in a total of N steps, until all unassigned hall calls are assigned.

5. The system of claim 4, wherein each step in the total of N steps includes a hall call for every passenger to be moved between floors of the building, such that during each step, an unassigned hall call from a passenger is considered sequentially in time, and is initially added to an elevator car of the plurality of elevator cars successively.

6. The system of claim 5, wherein for every combination of the hall call and the elevator car, the greedy optimization algorithm computes a cumulative waiting time of all hall calls assigned at that moment in time, plus the first hall call assigned at the initial step.

7. The system of claim 6, wherein the hall call and the elevator car combination having a least increase in the cumulative waiting time for all assigned hall calls including the first hall call of the initial step, the combination is accepted, and the hall call is assigned and removed from all the remaining unassigned hall calls, then continues to the next step or the next successive unassigned hall call.

8. The system of claim 1, wherein the greedy optimization algorithm is based on optimizing the approximated cumulative waiting time in N steps, where N is a number of unassigned hall calls from passengers waiting to be assigned at a time at each step, such that two sets of coefficients are computed to construct a quadratic Boolean approximation of the cumulative waiting time of all the plurality of hall calls from passengers currently waiting to be assigned at the time of that step.

9. The system of claim 8, wherein the first set of coefficients of the two sets of coefficients includes $w_i^c$, such that $w_i^c$ is a linear coefficient that is an expected waiting time of a hall call from a passenger $h_i$, if the hall call is picked by an elevator car c, and no other hall call is picked up by that elevator car.

10. The system of claim 1, wherein the second set of coefficients of the two sets of coefficients includes $w_{ij}^c$, such that $w_{ij}^c$ is a bilinear coefficient that is equal to the pairwise delay between hall calls from passengers $h_i$ and $h_j$, based on a specific pick-up order of the two hall calls by the elevator car c, such that only one of the two hall calls is causing a delay to the other hall call, and the hall call that is picked-up first causes a delay for the hall call that is picked-up second.

11. A method for scheduling elevator cars of an elevator system, comprising:

using at least one input interface for accepting a plurality of hall calls requesting the plurality of elevator cars to different floors of a building;

determining independently, using a processor in communication with the input interface, for each elevator car, an independent waiting time of accommodating each hall call, if the hall call is the only hall call assigned to the elevator car;

determining, for each pair of hall calls assigned for each elevator car, a pairwise delay over the individual waiting time of each hall call in the pair caused by a joint assignment of the elevator car to accommodate the pair of the hall calls;

approximating a cumulative waiting time of an assignment of the plurality of elevator cars to accommodate the plurality of hall calls as a sum of individual waiting times for accommodating each hall call with the assigned elevator car and a sum of all pairwise delays determined for the assigned elevator car between all pairs of hall calls assigned to the same elevator car;

determining the assignment of the plurality of elevator cars using a greedy optimization algorithm that greedily assigns the plurality of hall calls to the plurality of elevator cars to minimize the approximated cumulative waiting time; and using a controller for controlling the movement of the plurality of elevator cars according to the assignment.

12. The method of claim 11, wherein the greedy optimization algorithm is an algorithmic paradigm that determines at an initial step, an assignment of an unassigned first hall call, based on a locally optimal choice determined at a time of the initial step, then proceeds to the next step or the next successive unassigned hall call.

13. The method of claim 11, wherein the cumulative waiting time is determined according to $$Q(x)B\sum_{i=1}^{N}\sum_{c=1}^{C} w_i^c x_i^c + \sum_{i=1}^{N}\sum_{j=i+1}^{N}\sum_{c=1}^{C} w_{ij}^c x_i^c x_j^c,$$

where is an indicator variable which takes on a value of 1 when the hall call from the passenger i is assigned to the elevator car c, and 0 otherwise, and that all N·C indicator variables are collected in a decision vector $x=[x_1^1, x_2^1, \ldots, x_N^1, x_1^2, x_2^2, \ldots, x_N^2, \ldots, x_1^C, x_2^C, \ldots, x_N^C]$.

14. The method of claim 11, wherein the greedy optimization algorithm has complexity $O(CN^2)$ , that is, linear in a number of elevator cars C and quadratic in a number of hall calls by passengers N, and leverages a property of submodularity of an objective function.

15. The method of claim 14, wherein for each step, all remaining unassigned hall calls by passengers are considered sequentially in time, and are initially added to each elevator car successively, and for every combination of a hall call and an elevator car, the SPD of all hall calls assigned, plus the new hall call assigned at the initial step are then calculated, and any combination of the hall call initially added with the elevator car that increases the SPD least, then the hall call is assigned to that elevator car, and removed all the remaining unassigned hall calls, and then continues to the next step.

16. A non-transitory computer readable storage medium embodied thereon a program executable by a computer for performing a method, the method for scheduling elevator cars of an elevator system, the elevator system including a plurality of elevator cars, and a plurality of hall calls, comprising:

using at least one input interface for accepting a plurality of hall calls requesting the plurality of elevator cars to different floors of a building;

determining independently, using a process in communication with the input interface, for each elevator car, an independent waiting time of accommodating each hall call, if the hall call is the only hall call assigned to the elevator car;

determining, for each pair of hall calls assigned for each elevator car, a pairwise delay over the individual waiting time of each hall call in the pair caused by a joint assignment of the elevator car to accommodate the pair of the hall calls;

approximating a cumulative waiting time of an assignment of the plurality of elevator cars to accommodate the plurality of hall calls as a sum of individual waiting times for accommodating each hall call with the assigned elevator car and a sum of all pairwise delays determined for the assigned elevator car between all pairs of hall calls assigned to the same elevator car;

determining the assignment of the plurality of elevator cars using a greedy optimization algorithm that greedily assigns the plurality of hall calls to the plurality of elevator cars to minimize the approximated cumulative waiting time; and using a controller for controlling the movement of the plurality of elevator cars according to the assignment.

17. The method of claim 16, wherein the greedy optimization algorithm starts with an empty set of assignments of hall calls needing to be assigned, such that at every step including an initial step which starts with a first hall call, is added to the set of assignments of hall calls needing to be assigned, so as to result in a total of N steps, until all unassigned hall calls are assigned.

18. The method of claim 17, wherein each step in the total of N steps includes a hall call for every passenger to be moved between floors of the building, such that during each step, an unassigned hall call from a passenger is considered sequentially in time, and is initially added to an elevator car of the plurality of elevator cars successively.

19. The method of claim 18, wherein for every combination of the hall call and the elevator car, the greedy optimization algorithm computes a cumulative waiting time of all hall calls assigned at that moment in time, plus the first hall call assigned at the initial step.

20. The method of claim 19, wherein the hall call and the elevator car combination having a least increase in the cumulative waiting time for all assigned hall calls including the first hall call of the initial step, the combination is accepted, and the hall call is assigned and removed from all the remaining unassigned hall calls, then continues to the next step or the next successive unassigned hall call.

* * * * *